US008459056B2

(12) United States Patent
Shin et al.

(10) Patent No.: US 8,459,056 B2
(45) Date of Patent: Jun. 11, 2013

(54) REFRIGERATOR

(75) Inventors: Jong Min Shin, Busan (KR); Ju Hyun Kim, Jinhae (KR)

(73) Assignee: LG Electronics Inc., Seoul (KR)

( * ) Notice: Subject to any disclaimer, the term of this patent is extended or adjusted under 35 U.S.C. 154(b) by 538 days.

(21) Appl. No.: 11/969,054

(22) Filed: Jan. 3, 2008

(65) Prior Publication Data

US 2008/0156021 A1 Jul. 3, 2008

(51) Int. Cl.
*F25C 5/18* (2006.01)
*F25C 1/04* (2006.01)
*F25D 3/02* (2006.01)

(52) U.S. Cl.
USPC ..... 62/344; 62/356; 62/420; 62/425

(58) Field of Classification Search
USPC ..... 62/407, 529, 53, 340–356, 420, 425
See application file for complete search history.

(56) References Cited

U.S. PATENT DOCUMENTS

| | | | | |
|---|---|---|---|---|
| 2,717,505 | A | 9/1955 | Andersson | |
| 2,871,673 | A | 2/1959 | Richards et al. | |
| 2,912,836 | A | 11/1959 | Harle | |
| 3,144,078 | A | 8/1964 | Evans et al. | |
| 3,308,632 | A | 3/1967 | Winfield | |
| 3,788,089 | A * | 1/1974 | Graves | 62/137 |
| 4,199,956 | A | 4/1980 | Lunde | |
| 4,922,723 | A | 5/1990 | Broadbent | |
| 5,127,236 | A | 7/1992 | Von Blanquet | |
| 5,203,176 | A | 4/1993 | De Weered | |
| 5,297,394 | A | 3/1994 | Frohbieter et al. | |
| 5,408,844 | A | 4/1995 | Stokes | |
| 5,787,723 | A | 8/1998 | Mueller et al. | |
| 6,205,807 | B1 | 3/2001 | Broadbent | |
| 6,425,259 | B2 | 7/2002 | Nelson et al. | |
| 7,017,364 | B2 | 3/2006 | Lee et al. | |
| 7,188,479 | B2 * | 3/2007 | Anselmino et al. | 62/66 |
| 7,681,406 | B2 | 3/2010 | Cushman et al. | |
| 2001/0025505 | A1 * | 10/2001 | Nelson et al. | 62/371 |
| 2003/0167787 | A1 * | 9/2003 | Ohashi et al. | 62/443 |
| 2004/0083753 | A1 | 5/2004 | Kim et al. | |
| 2004/0107721 | A1 | 6/2004 | Choi et al. | |

(Continued)

OTHER PUBLICATIONS

U.S. Office Action dated Nov. 19, 2009 for related U.S, Appl. No. 11/969,067.

(Continued)

*Primary Examiner* — Frantz F. Jules
*Assistant Examiner* — Cassey D Bauer
(74) *Attorney, Agent, or Firm* — Ked & Associates LLP

(57) ABSTRACT

The present invention relates to a refrigerator, and more particularly, to a cold air flow passage structure for allowing ice, which is received in an ice-storing device provided in a refrigerating chamber door, to be in a frozen state without being melted.

The refrigerator of the present invention comprises a main body including at least a refrigerating chamber and a cold air flow passage for supplying cold air to the refrigerating chamber, a refrigerating chamber door for opening or closing the refrigerating chamber, and an ice bank provided in the refrigerating chamber door and having a container for storing ice therein, wherein at least a portion of the cold air discharged from the cold air flow passage is discharged directly to the ice bank.

According to the refrigerator of the present invention, even though an ice bank for storing ice is provided in a refrigerating chamber door, it is possible to prevent a phenomenon by which ice is partially melted and stuck again together.

Further, since ice is not partially melted and stuck again together, it is possible to prevent a phenomenon by which an overload is applied to an ice crusher provided in the ice bank.

17 Claims, 3 Drawing Sheets

U.S. PATENT DOCUMENTS

| | | | | |
|---|---|---|---|---|
| 2004/0237565 | A1* | 12/2004 | Lee et al. | 62/344 |
| 2005/0061016 | A1* | 3/2005 | Lee et al. | 62/340 |
| 2005/0061018 | A1* | 3/2005 | Kim et al. | 62/344 |
| 2005/0067406 | A1 | 3/2005 | Rajarajan et al. | |
| 2005/0126202 | A1 | 6/2005 | Shoukyuu et al. | |

OTHER PUBLICATIONS

U.S. Office Action dated Jan. 17, 2012 for related U.S. Appl. No. 11/969,067.

U.S. Office Action dated Apr. 25, 2012 for related U.S. Appl. No. 11/969,067.

U.S. Office Action dated Oct. 15, 2009 for U.S. Appl. No. 11/969,024.

U.S. Office Action dated May 17, 2010 for U.S. Appl. No. 11/969,024.

U.S. Office Action dated May 4, 2012 for U.S. Appl. No. 11/969,024.

U.S. Office Action dated May 4, 2012 for U.S. Appl. No. 11/969,076.

U.S. Office Action issued in No. 13/218,587 dated Nov. 27, 2012.

* cited by examiner

REFRIGERATOR

CROSS REFERENCE TO RELATED APPLICATIONS

This application claims priority to provisional application No. 60/883,329 filed Jan. 2, 2008 which is hereby incorporated by reference.

BACKGROUND OF THE INVENTION

1. Field of the Invention

The present invention relates to a refrigerator, and more particularly, to a cold air flow passage structure for allowing ice, which is received in an ice-storing device provided in a refrigerating chamber door, to be in a frozen state without being melted.

2. Description of the Related Art

Generally, a refrigerator is an electric home appliance for storing foods in a low temperature state so that the foods can be kept in a fresh state for an extended period of time.

Specifically, a refrigerator includes a refrigerating chamber that is maintained in a temperature range of 1 to 4° C. to store foods such as vegetables in a fresh state, and a freezing chamber that is maintained at about −18° C. to store foods such as meat or fish in a frozen state.

In addition, refrigerators are classified into a type in which a freezing chamber is positioned above a refrigerating chamber, a type in which a freezing chamber is positioned below a refrigerating chamber, and a type in which a freezing chamber and a refrigerating chamber are positioned side by side.

Alternatively, refrigerators may be classified into a side-by-side door refrigerator having right and left doors, and a single-side door refrigerator having upper and lower doors.

Meanwhile, an ice maker for making ice and an ice bank for storing the ice are provided in any one of the refrigerating chamber and the freezing chamber.

Specifically, in a case where the ice maker and the ice bank are provided in the freezing chamber, water stored in the ice maker is made into ice by means of a refrigerant that has passed through an evaporator, and the ice falls into and stored in the ice bank provided below the ice maker.

Meanwhile, in some refrigerators, the ice maker is provided in the refrigerating chamber, and the ice bank is provided at a refrigerating chamber door. In this case, since the refrigerating chamber is kept at a temperature above zero, the ice stored in the ice bank may be melted and stuck together.

Specifically, in a case where ice is melted and stuck together, there is a problem in that an overload may be applied to an ice crusher provided in the ice bank. More specifically, in a case where an overload is applied to the ice crusher, parts such as a motor for operating the ice crusher or a blade for crushing ice may be damaged. As a result, there is a disadvantage in that the life span of the ice bank is shortened, resulting in additional repair or replacement costs.

SUMMARY OF THE INVENTION

The present invention is conceived to solve the aforementioned problems. Accordingly, an object of the present invention is to provide a refrigerator, wherein ice stored in an ice bank provided at a refrigerating chamber door is kept in a frozen state without being melted.

Specifically, an object of the present invention is to provide a refrigerator, wherein ice stored in an ice bank is prevented from being melted and stuck together so that an ice crusher for crushing the ice is not damaged.

A refrigerator according to one aspect of the present invention for achieving the objects comprises a main body including at least a refrigerating chamber and a cold air flow passage for supplying cold air to the refrigerating chamber, a refrigerating chamber door for opening or closing the refrigerating chamber, and an ice bank provided in the refrigerating chamber door and having a container for storing ice therein, wherein at least a portion of the cold air discharged from the cold air flow passage is discharged directly to the ice bank.

A refrigerator according to another aspect of the present invention comprises a main body having at least a refrigerating chamber, a container provided in an inner surface of a door for opening or closing the refrigerating chamber, and a cold air duct provided in the main body to discharge cold air into the refrigerating chamber and having an end positioned toward an opening of the container.

With the structure described above, there is an advantage in that ice stored in the ice bank provided at the refrigerating chamber door can be kept in a frozen state without being melted.

BRIEF DESCRIPTION OF THE DRAWINGS

The above and other objects, features and advantages of the present invention will become apparent from the following description of a preferred embodiment given in conjunction with the accompanying drawings, in which.

DESCRIPTION OF THE PREFERRED EMBODIMENT

Hereinafter, a specific embodiment of the present invention will be described in detail with reference to the accompanying drawings. However, the spirit of the present invention is not limited to the following embodiment, and retrograde embodiments or other embodiments included in the scope of the present invention can be easily conceived by adding, changing or eliminating other components.

Figure 1:
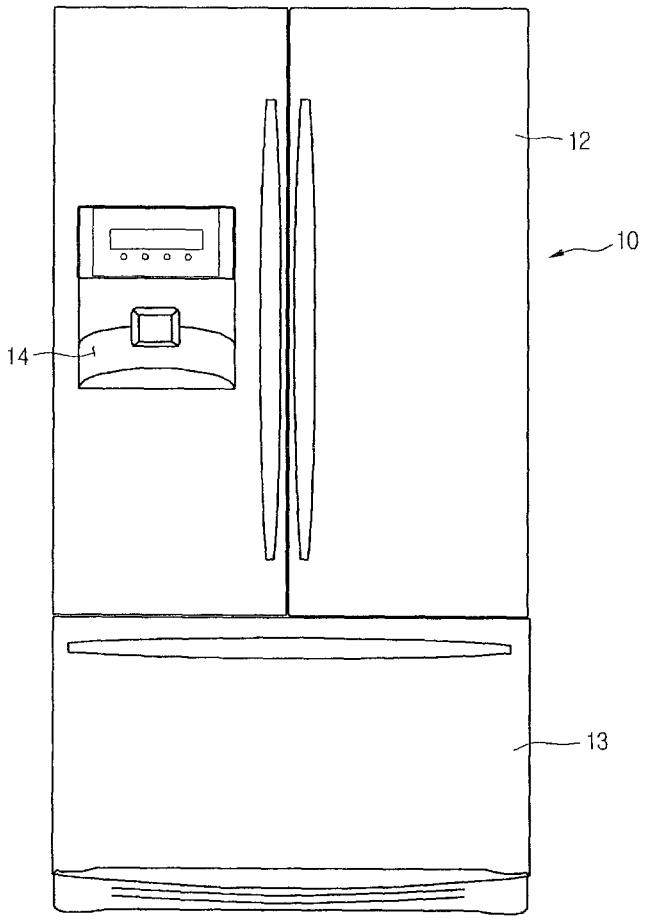
FIG. 1 is a front view of a refrigerator according to the present invention.
Figure 2:
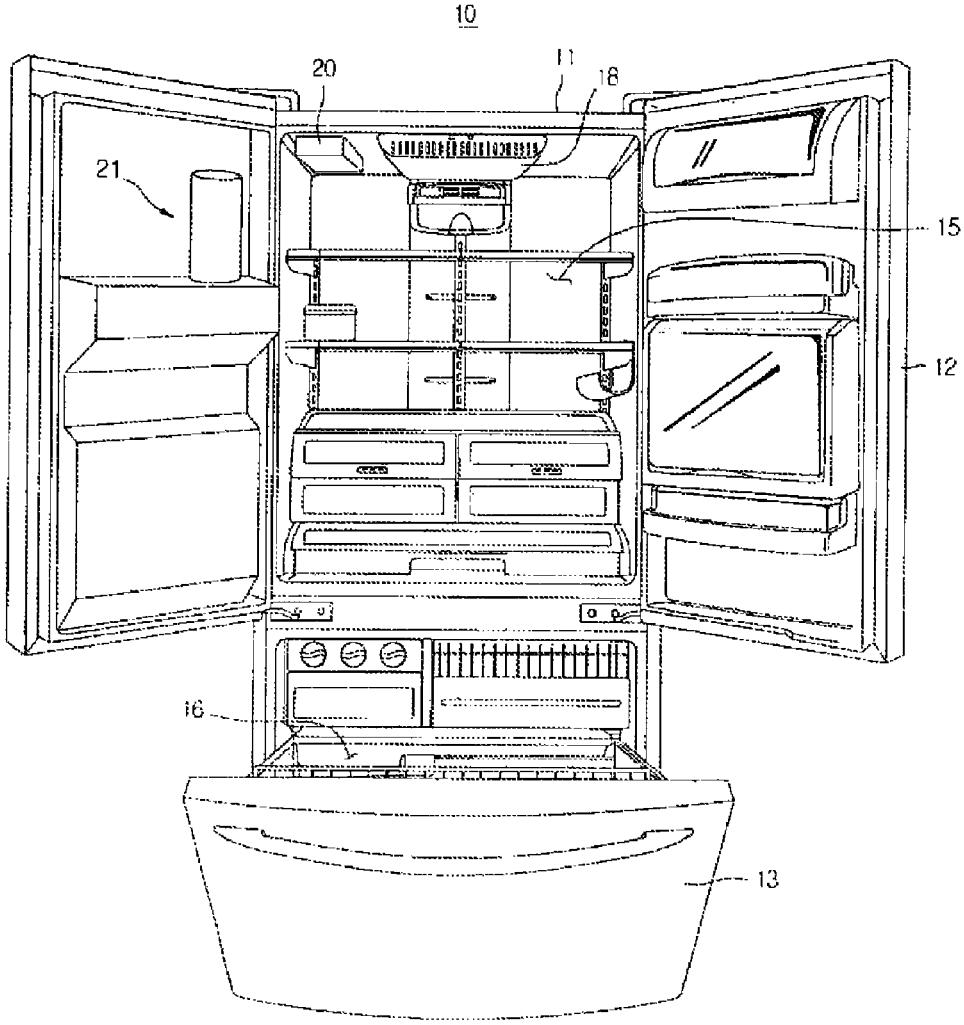
FIG. 2 is a perspective view showing the interior of the refrigerator according to the present invention.

FIG. 1 is a front view of a refrigerator according to the present invention, and FIG. 2 is a perspective view showing the interior of the refrigerator according to the present invention.

Referring to FIGS. 1 and 2, the refrigerator of the present invention will be described by way of example in connection with a bottom-freezer type refrigerator in which a refrigerating chamber is provided at an upper portion and a freezing chamber is provided at a lower portion.

The refrigerator 10 of the present invention includes a main body 11 having a refrigerating chamber 15 and a freezing chamber 16 provided therein, refrigerating chamber doors 12 for opening or closing the refrigerating chamber 15, and a freezing chamber door 13 for opening or closing the freezing chamber 16. Specifically, the refrigerating chamber 15 and the freezing chamber 16 are partitioned by means of a barrier 111 (see FIG. 3).

In addition, the refrigerator 10 further includes a compressor 32 provided at a lower portion of the main body 11 to compress a refrigerant, an evaporator 31 disposed at a rear portion of the main body 11 to generate cold air, and a blower fan 30 for causing the cold air generated by the evaporator 31 to be supplied into the refrigerating chamber 15 and the freezing chamber 16.

Moreover, the refrigerator 10 further includes a freezing duct 17 for supplying the cold air blown by the blower fan 30 to the freezing chamber 16, a refrigeration duct 18 for supplying the cold air to the refrigerating chamber 15, an ice maker 20 provided on a ceiling of the refrigerating chamber 15, and an ice bank 21 for storing ice made by the ice maker 20.

Specifically, the freezing duct 17 is provided with a plurality of cold air holes, and the cold air is discharged into the freezing chamber 16 through the cold air holes. Here, in addition to the structure in which the evaporator 31 and the blower fan 30 are disposed in the freezing duct 17, the evaporator 31 and the blower fan 30 may be provided in a separate space in the main body 11 and a freezing duct 17 connected to the freezing chamber 16 may be separately provided.

Furthermore, the refrigeration duct 18 extends from a space where the evaporator 31 is accommodated, and is then connected to the refrigerating chamber 15 through the barrier 111. Here, in addition to the structure in which the refrigeration duct 18 communicates directly with the space with the evaporator 31 accommodated therein, it should be noted that the refrigeration duct 18 may be branched off from the freezing duct 17.

As shown in the figures, the refrigerating chamber doors 12 are generally provided as side-by-side doors, and the freezing chamber door 13 is generally in the form of a drawer-type door. However, the freezing chamber door 13 may also be provided in the form of side-by-side doors.

With the structure described above, ice made by the ice maker 20 provided on the ceiling of the refrigerating chamber 15 is separated by an ejector (not shown) and then falls into the ice bank 21. Here, a guide extending from the ice maker 20 or the ice bank 21 may be provided such that the ice separated from the ice maker 20 can safely fall into the ice bank 21.

Specifically, the ice bank 21 has an upper face in the form of an opening, and the opening of the ice bank 21 is positioned below the ice maker 20 when the refrigerating chamber doors 12 are closed. In addition, ice may be made by supplying cold air directly to the ice maker 20 or by providing an additional refrigerant conduit to the ice maker.

Meanwhile, in a case where the ice bank 21 is provided in the refrigerating chamber 15 or the refrigerating chamber door 12, there may be a phenomenon by which ice stored in the ice bank is melted and stuck together since the refrigerating chamber 15 is kept at a temperature above zero.

To solve this problem, it is necessary to always maintain the interior of the ice bank 21 at a temperature below zero so that ice is not melted.

Hereinafter, a method of maintaining the interior of the ice bank 21 so that ice is not melted will be described in detail with reference to the accompanying drawings.

Figure 3:
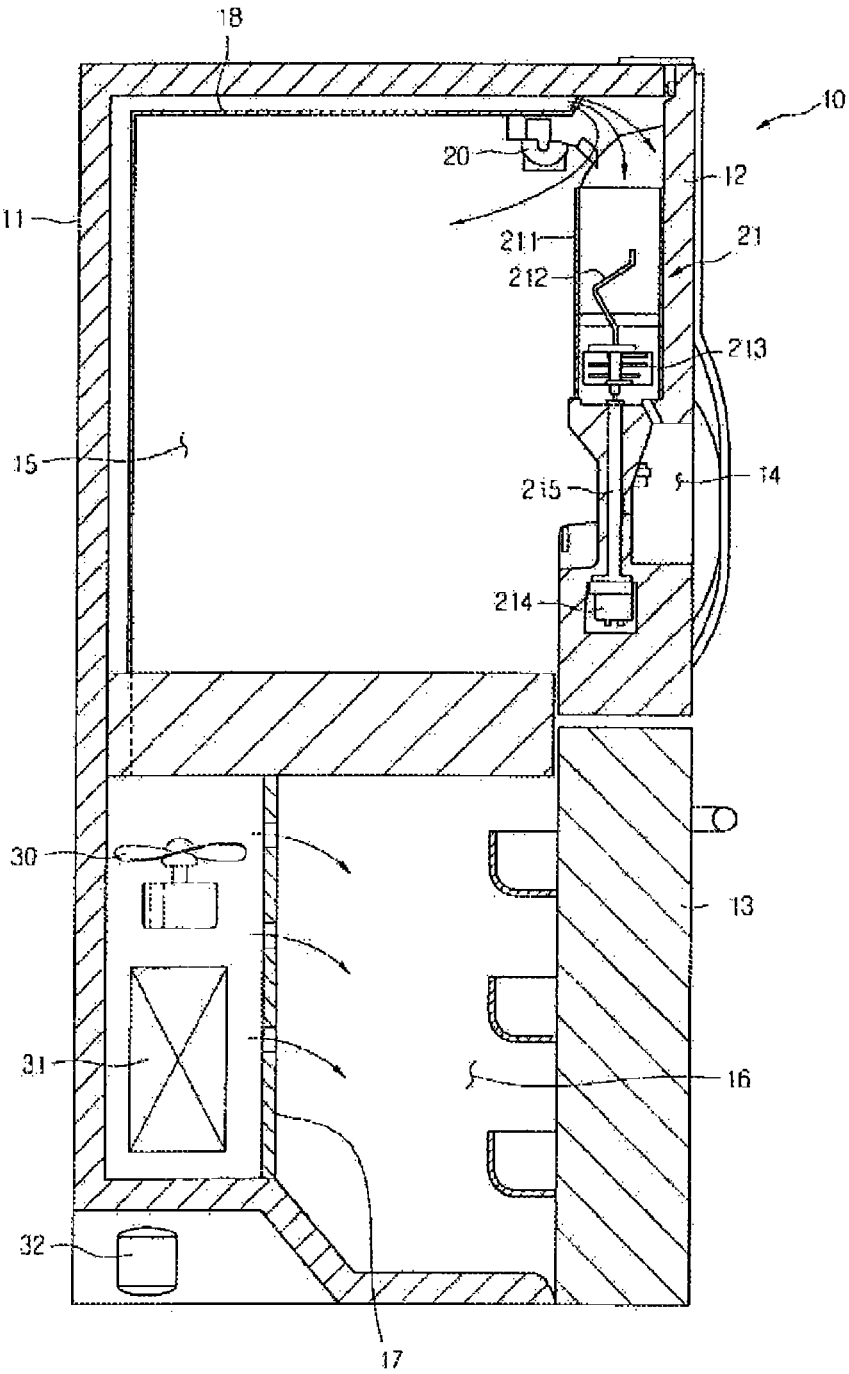
FIG. 3 is a side sectional view showing the structure of the refrigerator according to the present invention.

FIG. 3 is a side sectional view showing the structure of the refrigerator according to the present invention.

Referring to FIG. 3, the refrigerator 10 of the present invention is constructed such that the ice maker 20 and the ice bank 21 are disposed in the refrigerating chamber.

Specifically, the ice bank 21 includes a cylindrical container 211 with an open upper portion, an auger 212 provided at an inner lower portion of the container 211 to guide ice downward, a crusher 213 integrally connected to a lower end of the auger 212 to crush ice, a motor 214 for driving the crusher 213, and a shaft 215 for connecting the motor 214 to the crusher 213 so as to transmit a rotational force of the motor.

Furthermore, the ice maker 20 is provided at a side of the ceiling of the refrigerating chamber 15. Specifically, the ice maker 20 is positioned above the ice bank 21 such that ice discharged from the ice maker 20 can fall into the container 211.

Here, since any kind of ice maker can be used as the ice maker 20, a detailed description of the structure thereof will be omitted.

Meanwhile, the refrigeration duct 18 communicates with the space where the evaporator 31 is accommodated, and then extends upward along a wall of the refrigerating chamber 15 and to the ceiling of the refrigerating chamber 15. Then, an end of the refrigeration duct 18 extends to a front portion of the refrigerating chamber 15 and is positioned above the container 211. Thus, cold air flowing along the refrigeration duct 18 is discharged forward, and a portion of the discharged cold air falls into the container 211, and the remainder of the cold air circulates in the refrigerating chamber 15.

With this structure, at least a portion of cold air, which has been cooled to a lower temperature while passing through the evaporator 31, is discharged directly into the container 211, thereby effectively preventing a phenomenon by which ice accommodated in the container 211 is melted and stuck together.

Further, since the refrigeration duct 18 extends to the front portion of the refrigerating chamber 15 and the cold air discharged from the refrigeration duct 18 is discharged downward, it is possible to obtain an air curtain effect.

According to the refrigerator of the present invention constructed as above, even though an ice bank for storing ice is provided in a refrigerating chamber door, it is possible to prevent a phenomenon by which ice is melted and stuck together.

Further, since ice is not melted and stuck together, it is possible to prevent a phenomenon by which an overload is applied to an ice crusher provided in the ice bank.

In addition, since an overload is not applied to the ice crusher, components such as a motor for driving the ice crusher or a blade for crushing ice are not damaged. Thus, the life span of the ice bank is extended and additional repair and replacement costs are not required.

Moreover, since an end of a refrigeration duct is provided at a front portion of the refrigerating chamber, discharged cold air forms an air curtain.

Furthermore, cold air supplied through the evaporator is used to keep ice, which is stored in the ice bank exposed to the refrigerating chamber, in a frozen state, without using any additional ice preserving device, resulting in reduction of manufacturing costs of the refrigerator.

What is claimed is:

1. A refrigerator, comprising:

a main body including at least a refrigerating chamber and a freezing chamber disposed under the refrigerating chamber;

first and second refrigerating chamber doors for opening or closing the refrigerating chamber;

an ice maker disposed within the refrigerating chamber so as to be located behind the first refrigerating chamber door;

an ice bank mounted on the first refrigerating chamber door so as to be supplied with ice from the ice maker, wherein the ice bank is exposed to an interior of the refrigerating chamber;

an auger rotatably provided in the ice bank to guide the ice of the ice bank;

a motor to rotate the auger;

a dispenser disposed in the first refrigerating chamber door so as to dispense the ice received in the ice bank;

an evaporator disposed within the freezing chamber to supply cold air; and a cold air flow passage for supplying cold air from the freezing chamber to the ice bank in order to maintain the ice in the ice bank in a frozen state, wherein the cold air flow passage extends along a ceiling of the refrigerating chamber and wherein:

one or more holes located at an end section of the cold air flow passage is the only hole or are the only holes that direct cold air into the refrigerating chamber, the cold air passage is separated from being in communication with an interior of the refrigerating chamber continuously from a first point to a second point, the first point corresponds to a point at which the cold air passage enters the refrigerating chamber and the second point corresponds to a point where the one or more holes are located, and the cold air passage includes no air intake ports in the refrigerating chamber between the first point and the second point.

2. The refrigerator as claimed in claim 1, wherein the cold air flow passage comprises a duct member having the one or more holes positioned above an opening of the ice bank.

3. The refrigerator as claimed in claim 1, wherein the ice maker is disposed adjacent to the cold air flow passage.

4. The refrigerator as claimed in claim 1, wherein the ice bank has an opening at an upper portion, and at least a portion of the cold air discharged from the cold air flow passage through the one or more holes is discharged to the opening of the ice bank.

5. The refrigerator as claimed in claim 4, wherein a remaining portion of the cold air discharged from the cold air flow passage through the one or more holes is discharged into the refrigerating chamber.

6. The refrigerator as claimed in claim 1, wherein the dispenser includes an opening through which the ice is supplied to the outside of the first refrigerating chamber door.

7. The refrigerator as claimed in claim 1, wherein a portion of the cold air discharged from the cold air flow passage is supplied to the ice maker.

8. The refrigerator as claimed in claim 1, wherein:

the end section of the cold air flow passage including the one or more holes extends in a direction toward the refrigerating door, the one or more holes direct a first portion of the cold air towards the ice bank to maintain the ice in the ice bank in the frozen state, a second portion of the cold air not directed into the ice bank or which circulates out of the ice bank flows into the interior of the refrigerating chamber.

9. The refrigerator as claimed in claim 8, wherein the one or more holes in the end section of the cold air flow passage is/are located substantially above the ice maker or extend passed the ice maker in a direction towards the refrigerating chamber door.

10. The refrigerator as claimed in claim 9, wherein the cold air flow passage includes a first section that passes substantially parallel to a vertical wall of the refrigerating chamber and a second section that extends along the ceiling of the refrigerating chamber.

11. The refrigerator as claimed in claim 10, where no section of the cold air flow passage is coupled to the refrigerating chamber door.

12. The refrigerator as claimed in claim 1, wherein the cold air supplied from the cold air flow passage passes through the refrigerating chamber before being supplied to the ice bank.

13. A refrigerator, comprising:

a main body including at least a refrigerating chamber and a freezing chamber disposed under the refrigerating chamber;

first and second refrigerating chamber doors for opening or closing the refrigerating chamber;

an ice maker disposed within the refrigerating chamber so as to be located behind the first refrigerating chamber door;

an ice bank mounted on the first refrigerating chamber door so as to be supplied with ice from the ice maker, wherein an interior of the ice bank communicates with an interior of the refrigerating chamber;

an auger rotatably provided in the ice bank to guide the ice of the ice bank;

a motor to rotate the auger;

a dispenser disposed in the first refrigerating chamber door so as to dispense the ice received in the ice bank;

an evaporator disposed within the freezing chamber to supply cold air; and a cold air flow passage for supplying the cold air from the freezing chamber to the ice bank in order to maintain the ice in the ice bank in a frozen state, wherein the cold air flow passage extends along a ceiling of the refrigerating chamber and wherein:

one or more holes located at an end section of the cold air flow passage is the only hole or are the only holes that direct cold air into the refrigerating chamber., the cold air passage is separated from being in communication with an interior of the refrigerating chamber continuously from a first point to a second point, the first point corresponds to a point at which the cold air passage enters the refrigerating chamber and the second point corresponds to a point where the one or more holes are located, and the cold air passage includes no air intake ports in the refrigerating chamber between the first point and the second point.

14. The refrigerator as claimed in claim 13, wherein the cold air flow passage comprises a duct member having the one or more holes positioned above an opening of the ice bank.

15. The refrigerator as claimed in claim 13, wherein the ice maker is disposed adjacent to the cold air flow passage.

16. The refrigerator as claimed in claim 13, wherein the ice bank has an opening at an upper portion, and at least a portion of the cold air discharged from the cold air flow passage is discharged to an opening of the ice bank.

17. The refrigerator as claimed in claim 13, wherein a portion of the cold air discharged from the cold air flow passage is supplied to the ice maker.

* * * * *

UNITED STATES PATENT AND TRADEMARK OFFICE

CERTIFICATE OF CORRECTION

PATENT NO. : 8,459,056 B2
APPLICATION NO. : 11/969054
DATED : June 11, 2013
INVENTOR(S) : Jong Min Shin and Ju Hyun Kim It is certified that error appears in the above-identified patent and that said Letters Patent is hereby corrected as shown below:

On the Title Page, below Item (65) insert

-- (60) Related U.S. Application Data

| Application Number | Filing Date |
|---|---|
| 60/883,329 | January 3, 2007 -- |

Signed and Sealed this
First Day of July, 2014

Michelle K. Lee

Michelle K. Lee
*Deputy Director of the United States Patent and Trademark Office*